United States Patent [19]

Suga

[11] 3,986,063

[45] Oct. 12, 1976

[54] CARBON ARC LAMP PROVIDED WITH MEANS TO PREVENT ASH DEPOSITION

[76] Inventor: Shigeru Suga, Yoyogi 5-20-2 Shibuya, Tokyo, Japan

[22] Filed: June 27, 1975

[21] Appl. No.: 590,946

[52] U.S. Cl. ..... 313/46; 313/44; 313/45

[51] Int. Cl.[2] ..... H01J 7/24

[58] Field of Search ..... 313/44, 45, 46, 11

[56] References Cited

UNITED STATES PATENTS 3,859,551 1/1975 Ninerailles et al. ..... 313/46 X

*Primary Examiner*—R. V. Rolinec
*Assistant Examiner*—Darwin R. Hostetter
*Attorney, Agent, or Firm*—Wenderoth, Lind & Ponack

[57] ABSTRACT

A carbon arc lamp for use in a light fastness tester. The lamp has an arc glow section, a base located at the top of the arc glow section, a heat radiating means integral with the upper side of the base, a heat collecting means integral with the side of the base facing toward the glow section, and a glass bulb extending from the base around the glow section. The heat produced due to carbon arc discharge in the glow section is collected by the collecting means and radiated to the outside of the lamp by the radiating means aided by the convection of the outside atmosphere to hold the base at a temperature lower than that of the glass bulb so as to eliminate or reduce deposition of ash resulting from the combustion of carbon on the light transmitting glass bulb which is at a higher temperature than the base by virtue of the tendency of the ash to be deposited to different extents, depending upon temperature, to thereby ensure emission of light through the bulb at a substantially constant luminous intensity.

2 Claims, 7 Drawing Figures

CARBON ARC LAMP PROVIDED WITH MEANS TO PREVENT ASH DEPOSITION

This invention relates to improvements in carbon arc lamps used for testing materials for fastness to light, and it seeks to provide a carbon arc lamp in which a base atop a light source section is cooled to produce a temperature difference between the base and the glass bulb so as to eliminate deposition of ash produced due to the combustion of carbon on the glass bulb, and thus permit accurate light testing of samples with a constant intensity of illumination.

BACKGROUND OF THE INVENTION AND PRIOR ART

The prior art carbon arc lamps have a construction as shown in FIG. 1, comprising carbon electrodes 1 and 2, a holder 3 holding the carbon electrodes, an electromagnet 4 and a damper 5, and the lamp is adapted to automatically emit light by an electric discharge between the opposed electrodes.

A glass bulb 6 is mounted on a base 7 by a retaining spring means 8 and is removable for the replacement of the carbon electrodes. During the discharge between the carbon electrodes 1 and 2, they are combusted to produce ash, which strikes the inner surface of the base and flows along the inner surface of the glass bulb. The base is made of iron or bronze or a like alloy, and its temperature becomes as high as about 350° C from the heat of the arc. The temperature of the inner surface of the glass bulb, on the other hand, is raised only to about 50° C less than that of the base. Therefore, the ash is cooled when it strikes the inner surface of the glass bulb and is deposited on and dulls the glass.

Although the glass bulb may be cleaned every time the carbon electrodes are replaced, between changes it becomes gradually dirtier so that the intensity of light incident on the test sample is gradually reduced.

The prior art arc lamps thus have had the above drawback that ash is readily deposited on the glass bulb.

SUMMARY OF THE INVENTION

The instant device has an improved construction of the base which is adapted to be held at a tmeperature lower than that of the glass bulb so as to cause as much ash as possible to be deposited on the base rather than on the glass bulb.

BRIEF DESCRIPTION OF THE FIGURES

The invention will now be described in greater detail in connection with the accompanying drawing, in which.

DETAILED DESCRIPTION OF THE INVENTION

Figure 1:
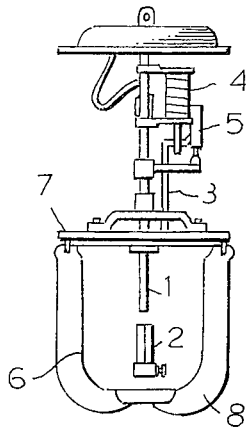
FIG. 1 is an elevation view showing a prior art carbon arc lamp.
Figure 2:
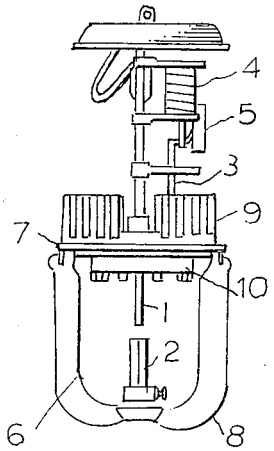
FIG. 2 is an elevation view of a carbon arc lamp according to the present invention.

Referring now to FIG. 2, a base 7 is provided which can be one-piece integral structure, such as a casting, and which has a radiating means 9 provided on the upper side and a heat collecting means 10 provided on the glow section side of the base. Numerals 1–8, respectively, designate the same parts as those of the prior art arc lamp described in connection with FIG. 1, namely a carbon electrode holder, an electromagnet, a damper, a glass bulb, and spring means.

Figure 3:
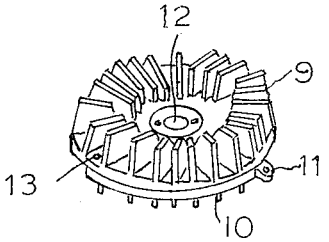
FIG. 3 is a perspective view of the base thereof.

FIG. 3 is a perspective view of the base provided with the radiating means 9, heat collecting means 10, and shows holes 11 for suspending springs 8, a hole 12 for the carbon electrode, and a hole 13 for mounting a frame carrying such control means as an electromagnet and a damper.

Figure 4:
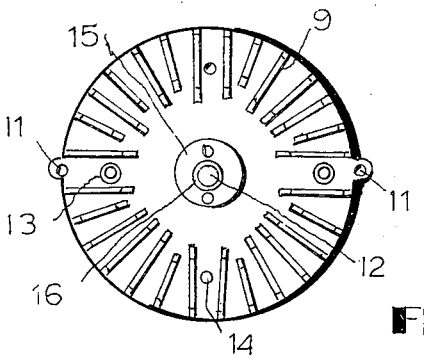
FIG. 4 is a plan view of the base of FIG. 3 showing the radiating means.

FIG. 4 is a plan view of the base. It has a plurality of, for instance 28, substantially radially spaced radiating fins 9. Designated at 11 are holes for suspending springs 8, at 14 a hole for means for mounting the lower carbon electrode holder, at 15 an insulating plate, at 16 bushing through which the carbon electrode is movable, at 12 the hole through which the carbon electrode extends, and at 13 a hole for mounting a frame carrying the control parts.

Figure 5:
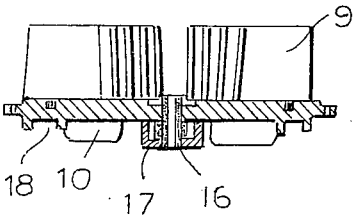
FIG. 5 is an axial sectional view of the base of FIG. 4.

FIG. 5 is a sectional view of the base. Designated at 9 is the radiating means, and at 10 the heat collecting means. Designated at 16 is the guide bushing, which is made of a ceramic material, and through which the carbon electrode 1 is movable. It is held in the base 7 by means of a cover 17. Designated at 18 is an annular groove for receiving the edge of the glass bulb 6.

Figure 6:
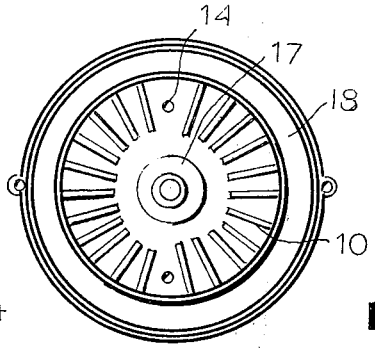
FIG. 6 is a bottom view of the base of FIG. 4 showing the heat collecting means.

FIG. 6 is a bottom view of the base showing the heat collecting means 10, which consists of a plurality of, for instance 22, radially spaced heat collecting fins. Designated at 18 is the annular groove for receiving the edge of the glass bulb 6, at 14 is the hole for the means for mounting the lower electrode holder, and at 17 the guide bushing cover.

Figure 7:
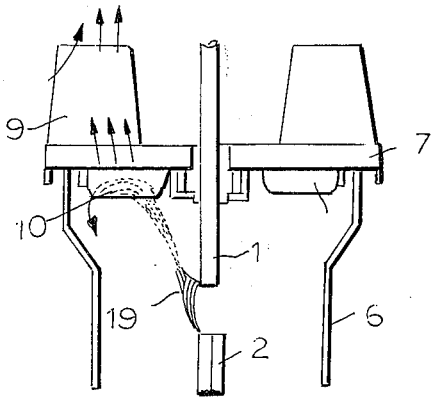
FIG. 7 is a schematic elevation view showing the operation of the arc lamp of the present invention.

Referring to FIG. 7, the dotted lines show the directions of flow of ash produced by the arc 19. As is shown, the ash flows upwardly toward the base 7 and then along the heat collecting means 10. While in the figure the arc is shown only on the left-hand side, actually it moves irregularly around the whole periphery of the carbon electrodes 1 and 2. The heat of the arc is collected by the heat collecting means 10, conducted to the radiating means 9 on the top of the base 7, and radiated to the outside, as indicated by the arrows, with the aid of the convection currents of the outside atmosphere. If the radiating means 9 has a sufficient radiating area, the temperature of the inner side (i.e. glow section side) of the base 7 can be made significantly lower than the temperature of the glass bulb 6. In experiments, it has been found that the base 7 and glass bulb 6 could be held at respective temperatures of 180° C and 250° C.

With the above arrangement, the ash is mostly deposited on the base 7 and hardly any ash is deposited on the glass bulb 6.

The arc lamp having the above construction was compared with a prior art lamp, and the following results were obtained:

Light permeability of the glass bulb measured after keeping the lamps "on " for 20 hours was 73.7% for the prior art arc lamp and 99.0% for the arc lamp of the present invention, indicating that less ash was deposited with the arc lamp of the present invention (the initial light permeability before the lamp is turned on being 100%).

Since the radiating means 9 and heat collecting means 10 on opposite sides of the base 7 are rib structure, the base 7 will not warp upon sudden cooling or heating. Also, its mechanical strength is high enough to maintain the flatness of the plane of the portion in contact with the glass bulb edge. Thus, it is possible to eliminate intrusion of air into the bulb during the carbon arc discharge and thereby ensure a steady glow.

What is claimed is:

1. A carbon arc lamp for use in a light fastness tester, said lamp comprising an arc glow section, a base located at the top of said arc glow section, a heat radiating means integral with the upper side of said base, a plurality of heat collecting fins integral with the side of said base facing toward said glow section and projecting from said base toward said glow section, and a glass bulb extending from said base around said glow section, whereby the heat produced due to carbon arc discharge in the glow section is collected by the collecting means and radiated to the outside of the lamp by the radiating means aided by the convection of the outside atmosphere to hold the base at a temperature lower than that of the glass bulb so as to eliminate or reduce deposition of ash resulting from the combustion of carbon on the light transmitting glass bulb which is at a higher temperature than the base by virtue of the tendency of the ash to be deposited to different extents depending upon temperature, to thereby ensure emission of light through the bulb at a substantially constant luminous intensity.

2. A carbon arc lamp as claimed in claim 1 in which said heat radiating means is a plurality of fins projecting from said base.

* * * * *